US008773046B2

(12) United States Patent
Lee

(10) Patent No.: US 8,773,046 B2
(45) Date of Patent: Jul. 8, 2014

(54) DRIVING CIRCUIT HAVING VOLTAGE DIVIDING CIRCUITS AND COUPLING CIRCUIT FOR CONTROLLING DUTY CYCLE OF TRANSISTOR AND RELATED CIRCUIT DRIVING METHOD THEREOF

(71) Applicant: Raydium Semiconductor Corporation, Hsinchu (TW)

(72) Inventor: Yu-En Lee, New Taipei (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 17 days.

(21) Appl. No.: 13/738,993

(22) Filed: Jan. 11, 2013

(65) Prior Publication Data

US 2014/0070719 A1 Mar. 13, 2014

(30) Foreign Application Priority Data

Sep. 7, 2012 (TW) ..... 101132785 A

(51) Int. Cl.
*H05B 37/02* (2006.01)

(52) U.S. Cl.
USPC ..... 315/307; 315/185 R; 315/224

(58) Field of Classification Search
USPC ..... 315/224, 307, 308, 291, 209 R, 185 R
See application file for complete search history.

(56) References Cited

U.S. PATENT DOCUMENTS

| | | | | |
|---|---|---|---|---|
| 7,550,934 | B1 * | 6/2009 | Deng et al. | 315/308 |
| 2009/0184666 | A1 * | 7/2009 | Myers et al. | 315/297 |
| 2009/0273290 | A1 * | 11/2009 | Ziegenfuss | 315/193 |

* cited by examiner

*Primary Examiner* — David H Vu

(57) ABSTRACT

A driving circuit includes: a first voltage dividing circuit arranged to generate a first voltage-divided signal according to a supply voltage; a second voltage dividing circuit arranged to generate a second voltage-divided signal according to specific voltage; a coupling circuit coupled between the first voltage dividing circuit and the second voltage dividing circuit, and arranged to couple the first voltage-divided signal into the second voltage-divided signal to generate a coupling signal; and a control circuit arranged to generate a control signal at least according to the coupling signal and a feedback signal to control a duty cycle of a transistor, wherein the feedback is generated by the transistor.

21 Claims, 5 Drawing Sheets

DRIVING CIRCUIT HAVING VOLTAGE DIVIDING CIRCUITS AND COUPLING CIRCUIT FOR CONTROLLING DUTY CYCLE OF TRANSISTOR AND RELATED CIRCUIT DRIVING METHOD THEREOF

BACKGROUND OF THE INVENTION

1. Field of the Invention

The disclosed embodiments of the present invention relate to a light-emitting diode (LED) driving circuit and related circuit driving method, and more particularly, to an LED driving circuit with a full operational voltage range, a better linear regulating ability and a power factor correction function, and a related circuit driving method thereof.

2. Description of the Prior Art

In the field of illumination, in order to achieve the purpose of energy saving, using lamps with light-emitting diodes (LED) as light sources to replace the traditional fluorescent tube is gradually popular. In general, the LED must be driven through a driving circuit to have the power-saving effect, wherein the driving circuit rectifies the sine wave output voltage of the general mains, and then provides the power to the LED in a periodic manner. Moreover, the current flowing into the LED would be proportional to the amplitude of the output voltage. In other words, the brightness of the LED would be proportional to the amplitude of the output voltage. Hence, the driving circuit must reduce the duty cycle of the LED to make the brightness of the LED remain unchanged. However, the amplitude of output voltage of mains around the world is not consistent. For example, the amplitude of the output voltage may be 110V (volts) or 220V. Hence, the conventional driving circuit can only be used under the output voltage with a single amplitude. Alternatively, an additional boost converter is used to raise the output voltage to a specific voltage, and then supplies the specific voltage to the LED. This implementation, however, would increase the manufacturing cost of the driving circuit. Further, since the driving circuit itself would have a delay time, the driving circuit can not immediately present the voltage variation of the mains in the current of the LED, which degrades the linear regulation performance of the driving circuit.

Therefore, how to design a low-cost LED driving circuit with a full voltage operating range and a better linear regulating ability has become a critical issue to be solved in this field.

SUMMARY OF THE INVENTION

Therefore, one of the objectives of the present invention is to provide an LED driving circuit with a full operational voltage range, a better linear regulating ability and a power factor correction function, and a related method thereof.

According to a first embodiment of the present invention, an exemplary driving circuit is disclosed. The driving circuit includes a first voltage dividing circuit, a second voltage dividing circuit, a coupling circuit, and a control circuit. The first voltage dividing circuit is arranged to generate a first voltage-divided signal according to a supply voltage. The second voltage dividing circuit is arranged to generate a second voltage-divided signal according to a specific voltage. The coupling circuit is coupled between the first voltage dividing circuit and the second voltage dividing circuit, and arranged to couple the first voltage-divided signal into the second voltage-divided signal to generate a coupling signal. The control circuit is arranged to generate a control signal according to at least the coupling signal and a feedback signal to control a duty cycle of a transistor; wherein the feedback signal is generated by the transistor.

According to a second embodiment of the present invention, an exemplary circuit driving method is disclosed. The circuit driving method includes: generating a first voltage-divided signal according to a supply voltage; generating a second voltage-divided signal according to a specific voltage; coupling the first voltage dividing circuit to the second voltage dividing circuit to generate a coupling signal; and generating a control signal according to at least the coupling signal and a feedback signal to control a duty cycle of a transistor; wherein the feedback signal is generated by the transistor.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is electrically connected to another device, that connection may be through a direct electrical connection, or through an indirect electrical connection via other devices and connections.

Figure 1:
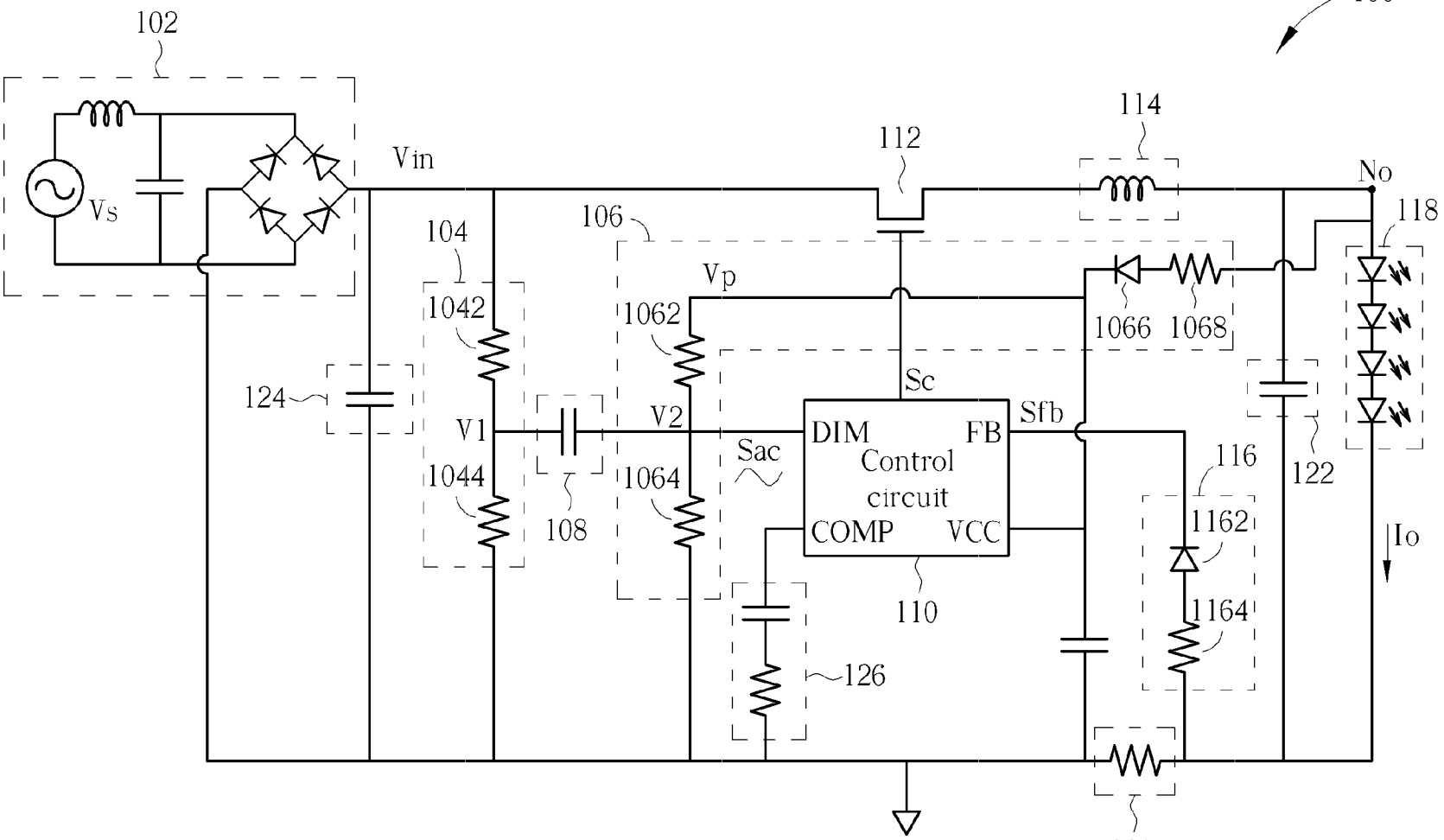
FIG. 1 is a diagram illustrating a driving circuit according to an exemplary embodiment of the present invention.

Please refer to FIG. 1. FIG. 1 is a diagram illustrating a driving circuit 100 according to an exemplary embodiment of the present invention. The driving circuit 100 includes a rectifier circuit 102, a first voltage-dividing circuit 104, a second voltage-dividing circuit 106, a coupling circuit 108, a control circuit 110, a transistor 112, an inductive component 114, and a feedback circuit 116. The driving circuit 100 is used to drive at least one LED. Therefore, FIG. 1 further illustrates an LED 118 in order to facilitate the description of the technical features of the driving circuit 100 of the present invention. The LED 118 includes at least one LED. The rectifier circuit 102 is used to convert an alternating current (AC) input voltage Vs to a rectified input voltage Vin, wherein the AC input voltage Vs may be a supply voltage from general mains. For instance, the supply voltage may be 110V or 220V AC voltage. The first voltage dividing circuit 102 is used to generate a first voltage-divided signal V1 according to a supply voltage. Furthermore, the first voltage dividing circuit 102 is used to perform voltage dividing upon the rectified input voltage Vin to generate the first voltage-divided signal V1. The second voltage dividing circuit 104 is used to generate a second voltage-divided signal V2 according to a specific voltage Vp, wherein the specific voltage Vp may be a constant voltage. The coupling circuit 108 is coupled between the first voltage dividing circuit 102 and the second voltage dividing circuit 104, and is used to couple the first voltage-divided signal V1 to the second voltage-divided signal V2 to generate a coupling signal Sac, wherein the coupling circuit 108 may be a capacitive component. More specifically, since the specific voltage Vp is a constant voltage in this embodiment, the second voltage-divided signal V2 is also a constant voltage when the first voltage-divided signal V1 is not emerged yet. However, when the first voltage-divided signal V1 emerges, the voltage seen from the input terminal DIM of the control circuit 110 would be the first voltage-divided signal V1 plus the constant second voltage-divided signal V2 (i.e., the coupling signal Sac) due to that the coupling circuit 108 is used to couple the AC signal of the first voltage-divided signal V1 to the second voltage dividing circuit 104 (i.e., the input terminal DIN of the control circuit 110). To put it another way, the coupling signal Sac is a result of adding the AC signal of the first voltage-divided signal V1 to the constant second voltage-divided signal V2.

The control circuit 110 is used to generate a control signal Sc according to at least the coupling signal Sac and a feedback signal Sfb for controlling a duty cycle of the transistor 112, wherein the feedback signal Sfb is generated by the output of the transistor 112 as shown in FIG. 1. The transistor 112 may be a switch transistor. More specifically, a first connection terminal of the transistor 112 is coupled to the rectified input voltage Vin, a control terminal of the transistor 112 is coupled to the control signal Sc, and a second connection terminal of the transistor 112 is coupled to a first terminal No of the inductive component 114. A second terminal of the inductive circuit 114 is coupled to a first terminal of a load, that is to say, the second terminal of the inductive circuit 114 is coupled to a first terminal (e.g., the anode) of the LED 118. In addition, a first terminal of a resistive circuit 120 is coupled to the second terminal (e.g., the cathode) of the load (i.e., LED 118), and a second terminal of the resistive circuit 120 is coupled to a reference voltage Vgnd (i.e., the ground voltage). The resistive circuit 120 is used to generate a corresponding voltage according to an output current Io of the driving circuit 100. The feedback circuit 116 is coupled between the first terminal of the resistive circuit 120 and a feedback terminal FB of the control circuit 110, and generates the feedback signal Sfb to the control circuit 110 according to the corresponding voltage.

In this embodiment, the feedback circuit 116 includes a first diode 1162 and a resistive circuit 1164. The first diode 1162 has a first terminal (e.g., the anode) coupled to the second terminal of the LED 118, and a second terminal (e.g., cathode) which is used to output the feedback signal Sfb. The resistive circuit 1164 has a first terminal coupled to the second terminal of the LED 118, and a second terminal coupled to the first terminal of the first diode 1162 as shown in FIG. 1.

In addition, in this embodiment, the first voltage dividing circuit 104 includes a first resistive component 1042 and a second resistive component 1044. The first resistive component 1042 has a first terminal coupled to the rectified input voltage Vin. The second resistive component 1044 has a first terminal coupled to a second terminal of the first resistive component 1042, and a second terminal coupled to the ground voltage Vgnd, wherein the second terminal of the first resistive component 1042 is used to output the first voltage-divided signal V1. The second voltage dividing circuit 106 includes a first resistive component 1062 and a second resistive component 1064. The first resistive component 1062 has a first terminal coupled to the specific voltage Vp. The second resistive component 1064 has a first terminal coupled to a second terminal of the first resistive 1062, and a second terminal coupled to the ground voltage Vgnd, wherein the second terminal of the first resistive component 1062 is used to provide the second voltage-divided signal V2. The coupling circuit 108 is coupled between the second terminal of the first resistive component 1042 of the first voltage dividing circuit 104 and the second terminal of the first resistive component 1062 of the second voltage dividing circuit 106, and the second terminal of the first resistive component 1062 of the second voltage dividing circuit 106 is used to output the coupling signal Sac to the control circuit 110. In addition, in this embodiment, the second voltage dividing circuit 106 further includes a second diode 1066 and a resistive circuit 1068. The second diode 1066 has a first terminal (e.g., the anode) coupled to the second terminal No of the inductive circuit 114, and a second terminal (e.g., the cathode) which is used to output the specific voltage Vp. The resistive circuit 1068 has a first terminal coupled to the second terminal No of the inductive circuit, and a second terminal coupled to the first terminal of the second diode 1066, as shown in FIG. 1.

Please note that, when the driving circuit 100 operates in a normal operation mode and the output current Io flows through the LED 118 under the condition that the voltage drop induced by the resistive circuit 120 and the resistive circuit 1068 is ignored, an output voltage Vo of the second terminal No of the inductive circuit is substantially fixed due to that the voltage across each LED of the LED 118 is substantially fixed. Therefore, when the driving circuit 100 operates in the normal operation mode, the specific voltage Vp may be a fixed voltage.

Figure 2:
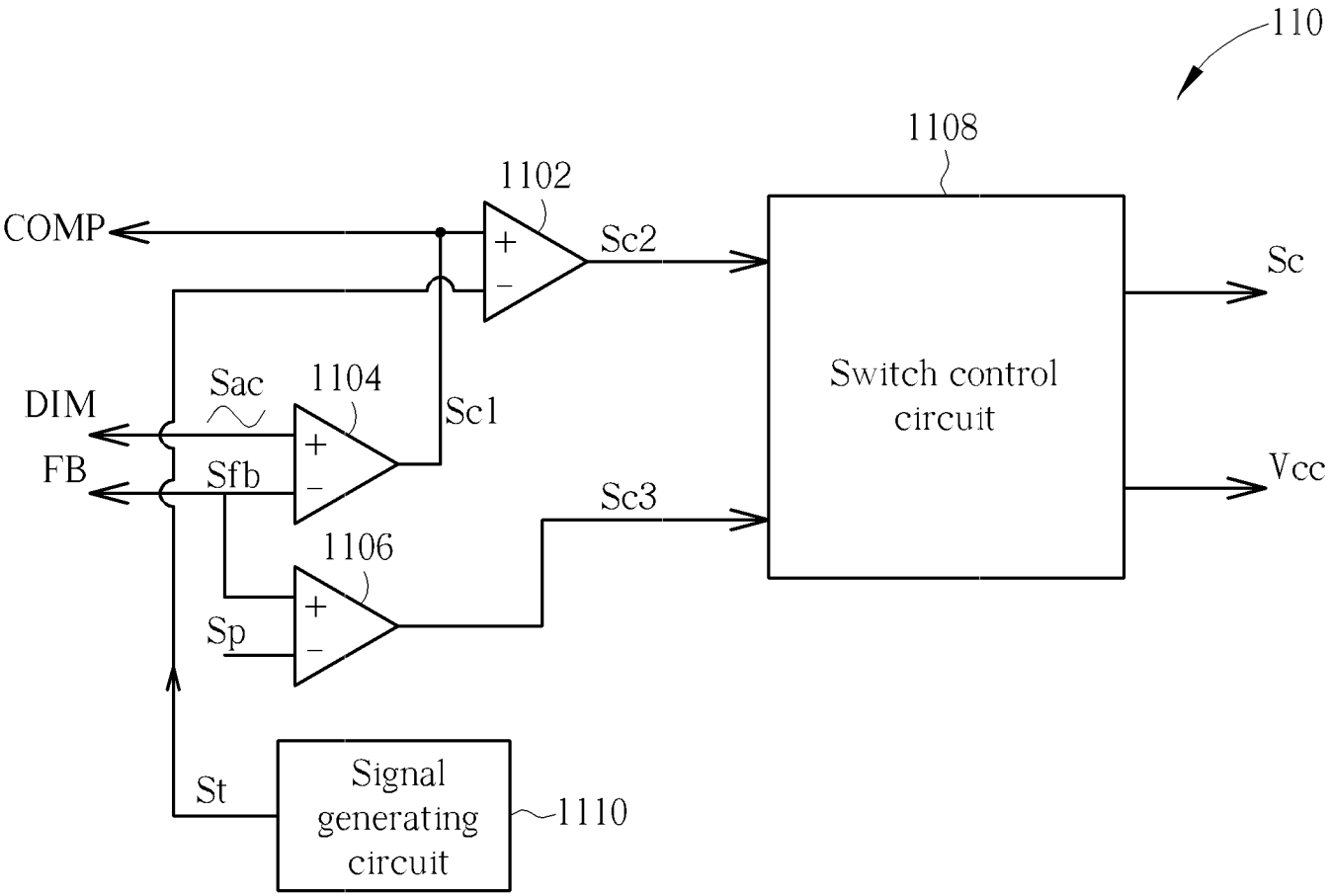
FIG. 2 is a diagram illustrating a control circuit according to an embodiment of the present invention.

On the other hand, please refer to FIG. 2, which is a diagram illustrating the control circuit 110 according to an embodiment of the present invention. The control circuit 110 includes a first comparing circuit 1102, a second comparing circuit 1104, a third comparing circuit 1106, a switch control circuit 1108, and a signal generating circuit 1110. The first comparing circuit 1102 is used to generate a first comparing output signal Sc1 according to the coupling signal Sac and the feedback signal Sfb. The second comparing circuit 1104 is used to generate a second comparing output signal Sc2 according to the first comparing output signal Sc1 and a sawtooth wave signal St. The third comparing circuit 1104 is used to generate a third comparing output signal Sc3 according to the feedback signal Sfb and a predetermined signal Sp. The switch control circuit 1108 is coupled to the second comparing circuit 1104 and the third comparing circuit 1106, and used to generate the control signal Sc to control the duty cycle of the transistor 112 according to at least one of the second comparing output signal Sc2 and the third comparing output signal Sc3. In addition, the signal generating circuit 1110 is used to generate the sawtooth wave signal St, which may be a triangular wave. Besides, the first comparing circuit 1102 may be (but not limited to) an operational transconductance amplifier (OTA).

It should be noted that, in this embodiment, the driving circuit 100 further includes capacitive circuits 122 and 124, wherein the capacitive circuit 122 has a first terminal coupled to the terminal No and a second terminal coupled to the ground voltage Vgnd, and the capacitive circuit 124 has a first terminal coupled to the rectified input voltage Vin and a second terminal coupled to the ground voltage Vgnd. In this embodiment, the driving circuit 100 further includes a compensating circuit 126, which is coupled between the terminal COMP of the driving circuit 100 and the ground voltage Vgnd. The compensating circuit 126 includes a capacitor connected in series with a resistor, as shown in FIG. 1.

Figure 3:
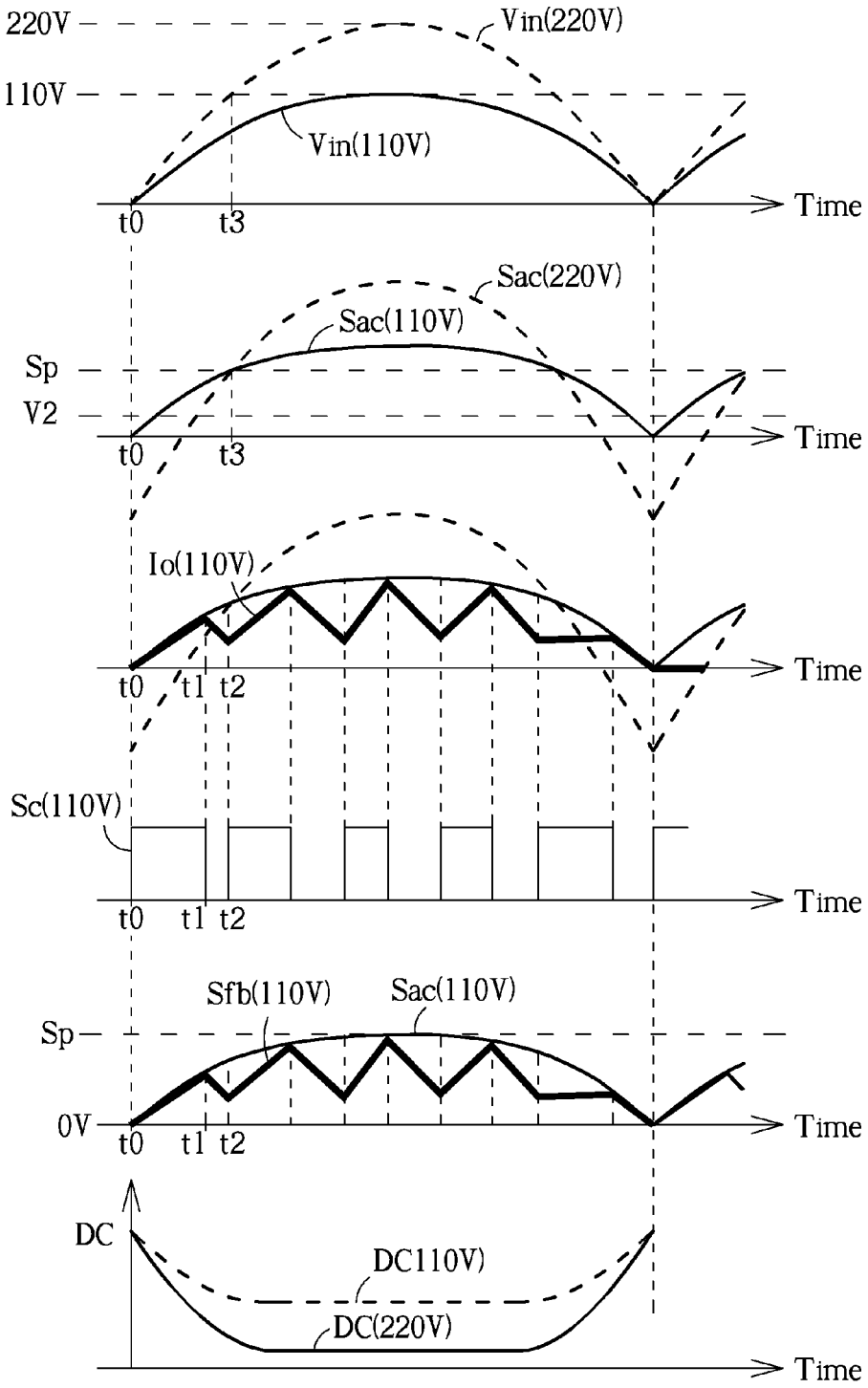
FIG. 3 is a timing diagram illustrating a rectified input voltage, a coupling signal, an output current, a control signal, a feedback signal and a duty cycle of a transistor when a driving circuit is operating under 110V AC supply voltage according to an embodiment of the present invention.
Figure 4:
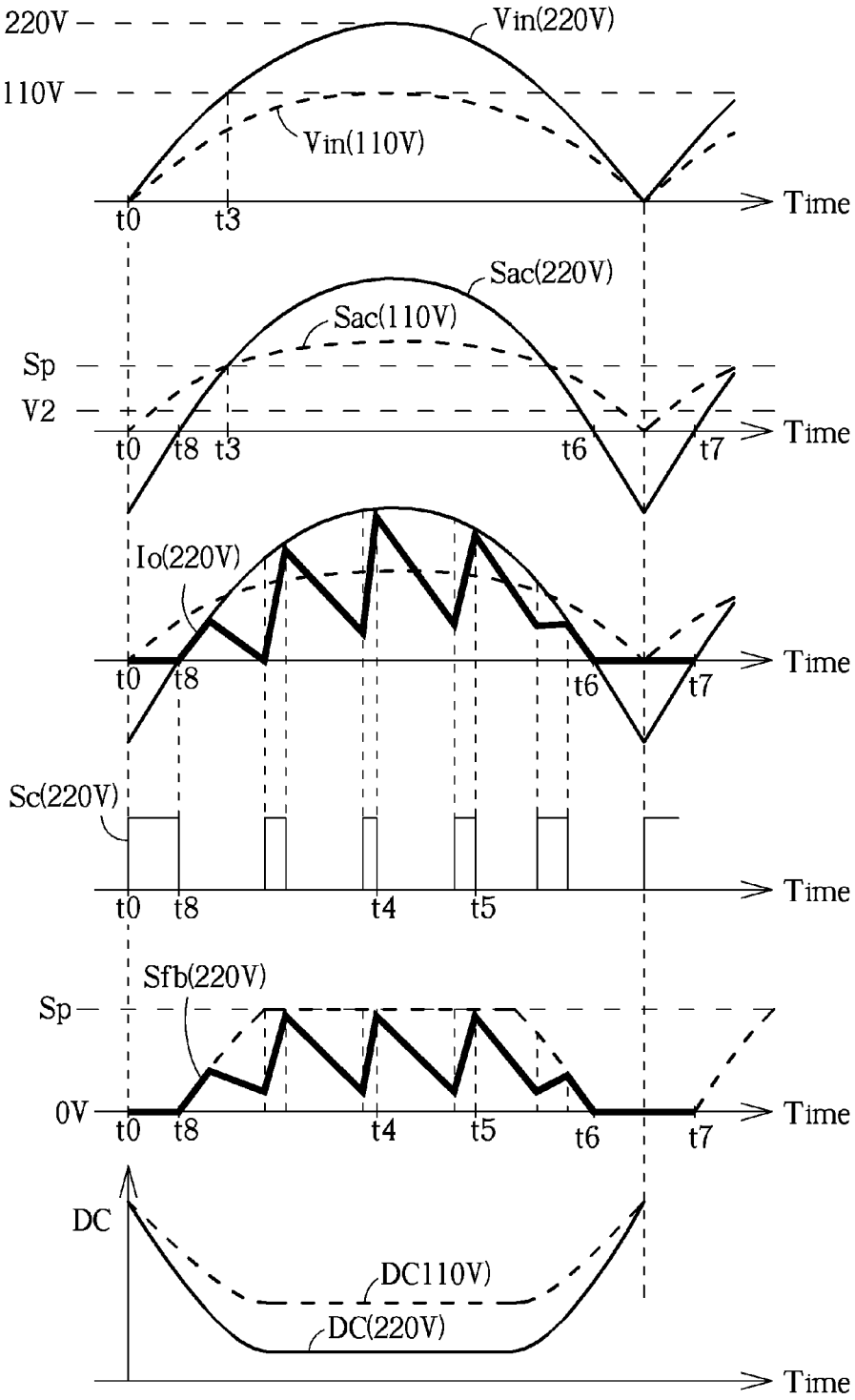
FIG. 4 is a timing diagram illustrating the rectified input voltage, the coupling signal, the output current, the control signal, the feedback signal and the duty cycle of the transistor when the driving circuit is operating under 220V AC supply voltage according to an embodiment of the present invention.

When the driving circuit 100 operates in the normal operation mode, the driving circuit 100 would control the duty cycle of the transistor 112 according to the rectified input voltage Vin and the feedback signal Sfb to make the average current flowing through the LED 118 substantially unchanged, thus further making the luminous intensity of the LED 118 remain the same, as shown in FIG. 3 and FIG. 4. FIG. 3 and FIG. 4 are timing diagrams illustrating the rectified input voltage Vin, coupling signal Sac, the output current Io, the control signal Sc, the feedback signal Sfb, and the duty cycle DC of the transistor 112 of the driving circuit 100 operating under two different supply voltages respectively (e.g., the 110V AC in FIG. 3 and the 220V AC in FIG. 4) according to an embodiment of the present invention. It should be noted that (110V) and (220V) are further labeled beside the rectified input voltage Vin, the coupling signal Sac, and the duty cycle DC of the transistor 112 to distinguish between the corresponding waveforms of the AC voltage 110V and 220V. On the other hand, FIG. 3 and FIG. 4 only illustrate the timing variation of a half-cycle waveform of the rectified input voltage Vin, coupling signal Sac, the output current Io, the control signal Sc, the feedback signal Sfb, and the duty cycle DC of the transistor 112 for brevity. Those skilled in the art should understand the remaining timing variations.

First, taking the AC input voltage Vs being an 110V AV voltage (i.e., the timing chart of the solid line as shown in FIG. 3) for example, when the driving circuit 100 receives the 110V AC voltage, the rectifier circuit 102 would rectify the 110V AC voltage to generate a positive half-wave voltage, such as Vin (110V) shown in FIG. 3. Meanwhile, the first voltage-dividing circuit 104 would divide the rectified positive half-wave 110V voltage into the first voltage-divided signal V1. Due to that the first voltage-divided signal V1 is only a voltage-divided signal of the rectified input voltage Vin, the timing diagram of the waveform of the first voltage-divided signal V1 is similar to that of the rectified input voltage Vin. Thus, the timing diagram of the waveform of the first voltage-divided signal V1 is not shown in FIG. 3 for simplicity. At this moment, the coupling circuit 108 (e.g., a capacitor) couples the first voltage-divided signal V1 to the second terminal of the first resistive component 1062 (i.e., the input terminal DIM of the control circuit 110) to generate the coupling signal Sac (i.e., the Sac (110V) shown in FIG. 3) into the input terminal DIM of the control circuit 110. Please note that when the driving circuit 100 receives the 110V AC voltage, the amplitude of the coupling signal Sac (110V) of this embodiment can be just between 0V and the predetermined signal Sp via an appropriate design, as shown in FIG. 3. For instance, the predetermined signal Sp may be a constant voltage (e.g., 250 mV).

The amplitude of the coupling signal Sac (110V) would not exceed the predetermined signal Sp (i.e., 250 mV). Therefore, when the voltage level of the coupling signal Sac (110V) gradually increases after time t0, the first comparing circuit 1102 shown in FIG. 2 would start comparing the voltage level of the coupling signal Sac (110V) and the feedback signal Sfb (110V) to generate the first comparing output signal Sc1. In addition, the third comparing circuit 1106 would transmit the third comparing output signal Sc3 (e.g., a low voltage level) to the switch control circuit 1108, thereby informing the switch control circuit 1108 that the voltage level of the coupling signal Sac (110V) is less than the predetermined signal Sp. For instance, if the voltage level of the feedback signal Sfb (110V) is less than the coupling signal Sac (110V), the first comparing output signal Sc1 would be a high voltage level. On the contrary, if the voltage level of the feedback signal Sfb (110V) is greater than the coupling signal Sac (110V), the first comparing output signal Sc1 would be a low voltage level. Then, the second comparing circuit 1104 would generate a second comparing output signal Sc2 according to the voltage level of the first comparing output signal Sc1 and the sawtooth wave signal St. After that, the switch control circuit 1108 would control the transistor 112 to be turned on or turned off in accordance with the second comparing output signal Sc2. It should be noted that, as a person skilled in the art should readily understand that the second comparing output signal Sc2 may be an oscillation signal, and the duty cycle of the oscillation signal is relevant to the voltage level of the first comparing output signal Sc1, further description is thus omitted here for brevity.

For instance, as shown in FIG. 3, the voltage level of the feedback signal Sfb (110V) at time t1 would rise to just over the voltage level of the coupling signal Sac (110V) because of the increase in the output current Io (110V). At this time, the switch control circuit 1108 would turn off the transistor 112. When the transistor 112 is turned off, the output current Io (110V) would gradually decrease, thus making the voltage level of the feedback signal Sfb (110V) gradually decrease. At time t2, the switch control circuit 1108 would turn on the transistor 112 again. Hence, the output current Io (110V) would change with the waveform of the rectified input voltage Vin (110V) and thus has a sawtooth waveform.

Please note that when the voltage level of the coupling signal Sac (110V) gradually increases, the increasing speed (i.e., the slope) of the output current Io (110V) would also increase. To put it another way, when the voltage level of the coupling signal Sac (110V) gradually increases, the voltage level of the feedback signal Sfb (110V) would reach the voltage level of the coupling signal Sac (110V) with a relatively higher speed (i.e., with a greater slope). However, when the voltage level of the coupling signal Sac (110V) gradually decreases, the voltage level of the feedback signal Sfb (110V) would reach the voltage level of the coupling signal Sac (110V) with a relatively lower speed (i.e., with a smaller slope). Thus, when the voltage level of the coupling signal Sac (110V) gradually increases, the time interval in which the switch control circuit 1108 turns on the transistor 112 would gradually become shorter (i.e., the duty cycle of the transistor 112 becomes shorter); and when the voltage level of the coupling signal Sac (110V) gradually decreases, the time interval in which the switch control circuit 1108 turns on the transistor 112 would gradually become longer (i.e., the duty cycle of the transistor 112 becomes longer), as illustrated by the control signal Sc (110V) and the duty cycle DC (110V) shown in FIG. 3. Therefore, when the driving circuit 100 operates at the normal operation mode, the average output current flowing through the LED 118 can substantially remain unchanged, or at least can remain in an acceptable range. This is because that the turn-on period of the transistor 112 becomes shorter when the output current Io (110V) increases, and vice versa.

Moreover, as can be seen from FIG. 3, when the voltage level of the coupling signal Sac (110V) gradually increases, the output current Io (110V) would gradually increase in synchronization. On the other hand, when the voltage level of the coupling signal Sac (110V) gradually decreases, the output current Io (110V) would gradually decrease in synchronization. Hence, the driving circuit 100 would have better linear regulating ability in the normal operation mode.

In the following paragraphs, a 220V AC voltage serves as an example of the AC input voltage Vs for illustrating the operation of the driving circuit 100. Similarly, when the driving circuit 100 receives the 220V AC voltage, the rectifier circuit 102 would rectify the 220V AC voltage to generate a positive rectified half-wave voltage, such as Vin (220V) shown in FIG. 4. Meanwhile, the first voltage-dividing circuit 104 would divide the rectified positive half-wave 220V voltage and accordingly generate the first voltage-divided signal V1. Due to that the first voltage-divided signal V1 is only a voltage dividing signal of the rectified input voltage Vin, the timing chart of the waveform of the first voltage-divided signal V1 is similar to the timing chart of the waveform of the rectified input voltage Vin. Thus, the timing chart of the waveform of the first voltage-divided signal V1 is not illustrated for brevity. At the same time, the coupling circuit 108 (e.g., a capacitor) couples the first voltage-divided signal V1 to the second terminal of the first resistive component 1062 (i.e., the input terminal DIM of the control circuit 110) to generate the coupling signal Sac (i.e., the Sac (220V) shown in FIG. 4) to the input terminal DIM of the control circuit 110. Please note that, when the driving circuit 100 receives 220V AC voltage, the amplitude of the coupling signal Sac (220V) of this embodiment is greater than the predetermined signal Sp (e.g., 250 mV), as shown in FIG. 4.

The amplitude of the coupling signal Sac (220V) would not exceed the predetermined signal Sp (i.e., 250 mV). Hence, when the voltage level of the coupling signal Sac (220V) gradually increases after time t0 and the voltage level of the coupling signal Sac (220V) is less than the predetermined signal Sp (i.e., before the time t3), the first comparing circuit 1102 shown in FIG. 2 would start comparing the voltage level of the coupling signal Sac (220V) and the feedback signal Sfb (220V) (i.e., the bold-line waveform shown in FIG. 4) to generate the first comparing output signal Sc1 used for controlling the on/off status of the transistor 112. In addition, the third comparing circuit 1106 would transmit the third comparing output signal Sc3 (e.g., a low voltage level) to the switch control circuit 1108, thus informing the switch control circuit 1108 that the voltage level of the coupling signal Sac (220V) is less than the predetermined signal Sp. Please note that, as the detailed operation is similar to the operation associated with 110V AC voltage, further description is thus omitted here for brevity.

However, when the voltage level of the coupling signal Sac (220V) starts to exceed the voltage level of the coupling signal Sac (220V) after time t3, the third comparing circuit 1106 would be used to limit the voltage level of the feedback signal Sfb (220V), thus making the voltage level of the feedback signal Sfb (220V) not greater than the voltage level of the coupling signal Sac (220V). More specifically, after time t3, the voltage level of the feedback signal Sfb (220V) would rise along with the increase in the coupling signal Sac (220V). But, when the voltage level of the feedback signal Sfb (220V) reaches the predetermined signal Sp, the third comparing circuit 1106 would output the third comparing output signal Sc3 (e.g., a high voltage level) to the switch control circuit 1108, to indicate the switch control circuit 1108 to turn off the transistor 112, for instance, at time t4 and t5. Therefore, when the rectified input voltage Vin exceeds 110V (i.e., the coupling signal Sac (220V) exceeds 250 mV), the voltage level of the feedback signal Sfb (220V) would change with the waveform of the predetermined signal Sp to have a sawtooth waveform without exceeding 250 mV, as shown in FIG. 4. Meanwhile, when the rectified input voltage Vin exceeds 110V (i.e., the coupling signal Sac (220V) exceeds 250 mV), the voltage level of the coupling signal Sac (220V) would be continuously greater than the voltage level of the feedback signal Sfb (220V) due to that the voltage level of the feedback signal Sfb (220V) is limited below 250 mV. Therefore, the first comparing circuit 1102 would continuously generate the first comparing output signal Sc1 with a constant voltage level (e.g., a high voltage level) to the second comparing circuit 1104. Please note that the first comparing circuit 1102 may generate a variable voltage level, where the variable voltage level may be proportional or inversely proportional to a voltage difference between the feedback signal Sfb (220V) and the feedback signal Sfb (220V). Next, the second comparing circuit 1104 would generate the second comparing output signal Sc2 in accordance with the sawtooth wave signal St and the constant voltage level of the first comparing output signal Sc1. Then, the switch control circuit 1108 would control the duty cycle of the transistor 112 in accordance with the second comparing output signal Sc2. More specifically, by appropriately designing the switch control circuit 1108, the switch control circuit 1108 can reduce the duty cycle of the transistor 112 according to the second comparing output signal Sc2 and the third comparing output signal Sc3, thus allowing the average value of the output current Io (220V) to substantially remain unchanged or at least remain in an acceptable range.

Please note that when the voltage level of the coupling signal Sac (220V) exceeds 250 mV and then gradually increases, the increasing speed (i.e., the slope) of the output current Io (220V) (i.e., the bold-line waveform shown in FIG. 4) would also increase. To put it another way, when the voltage level of the coupling signal Sac (220V) gradually increases, the voltage level of the feedback signal Sfb (220V) would reach the voltage level of the predetermined signal Sp (i.e., 250 mV) with a relatively higher speed (i.e., with a greater slope). However, when the voltage level of the coupling signal Sac (220V) gradually decreases, the voltage level of the feedback signal Sfb (220V) would reach the voltage level of the predetermined signal Sp (i.e., 250 mV) with a relatively lower speed (i.e., with a smaller slope). Thus, when the voltage level of the coupling signal Sac (220V) exceeds 250 mV and then gradually increases, the time interval in which the switch control circuit 1108 turns on the transistor 112 would gradually become shorter (i.e., the duty cycle of the transistor 112 becomes shorter), and when the voltage level of the coupling signal Sac (220V) gradually decreases, the time interval in which the switch control circuit 1108 turns on the transistor 112 would gradually become longer (i.e., the duty cycle of the transistor 112 becomes longer), as illustrated by the control signal Sc (220V) and the duty cycle DC (220V) shown in FIG. 4. Therefore, when the driving circuit 100 operates at the normal operation mode, the average output current flowing through the LED 118 can substantially remain unchanged, or at least can remain in an acceptable range. This is because that the turn-on period of the transistor 112 becomes shorter when the output current Io (220V) increases, and vice versa.

Moreover, as can be seen from FIG. 4, when the voltage level of the coupling signal Sac (220V) gradually increases, the output current Io (220V) would gradually increase in synchronization. On the other hand, when the voltage level of the coupling signal Sac (220V) gradually decreases, the output current Io (220V) would gradually decrease in synchronization. Hence, the driving circuit 100 would have better linear regulating ability in the normal operation mode. In addition, by using the method described above, no matter whether the input voltage Vin is 110V or 220V, the output current Io of the driving circuit 100 of the present invention would be substantially synchronous to the voltage variation of the input voltage Vin. Hence, the embodiments of the present invention also have the power factor correction functionality.

Further, as can be seen from FIG. 4, the voltage of the coupling signal Sac (220V) between time t0 and time t8 and between time t6 and t7 would be a negative voltage due to that the coupling circuit 108 is a capacitor. Meanwhile, the voltage of the feedback signal Sfb (220V) between time t0 and time t8 and between time t6 and t7 would be 0V. Therefore, during the period between time t0 and time t8 and the period between time t6 and t7, the first comparing circuit 1102 would continuously output the first comparing output signal Sc1 with the low voltage level, and the second comparing circuit 1104 would continuously output the second comparing output signal Sc2 with the low voltage level. Then, the switch control circuit 1108 would turn off the transistor 112 in accordance with the first comparing output signal Sc1 and the second comparing output signal Sc2, to make the output current Io (220V) substantially remain unchanged between time t0 and time t8 and between time t6 and time t7.

It can be known from above description that when the AC input voltage Vs is 110V, the control circuit 110 may be used to compare the voltage levels of the coupling signal Sac and the feedback signal Sfb (i.e., via the first comparing circuit 1102) to adjust the output current Io due to that the voltage level of the coupling signal Sac would fall between 0V and 250 mV. When the voltage level of the AC input voltage Vs is 220V, the control circuit 110 may be used to compare the voltage levels of the coupling signal Sac and the feedback signal Sfb (i.e., via the first comparing circuit 1102) and compare the voltage levels of the feedback signal Sfb and the predetermined signal Sp (i.e., via the third comparing circuit 1106) to adjust the output current Io due to that the voltage level of the feedback signal Sfb would be substantially limited between 0V and 250 mV. Therefore, the greater is the amplitude of the AC input voltage Vs, the smaller the duty cycle of the transistor 112 which can be rectified by the control circuit 110 is (i.e., smaller than the duty cycle when the AC input voltage Vs is 110V), thus allowing the average output current which flows through the LED 118 to remain substantially unchanged or at least remain in an acceptable range.

To put it another way, when the voltage level of the feedback signal Sfb does not exceed the voltage level of the predetermined signal Sp, the switch control circuit 1108 would mainly generate the control signal Sc in accordance with the second comparing output signal Sc2, to control the duty cycle of the transistor 112. When the voltage level of the feedback signal Sfb exceeds the voltage level of the predetermined signal Sp, the switch control circuit 1108 would generate the control signal Sc in accordance with the second comparing output signal Sc2 and the third comparing output signal Sc3, to control the duty cycle of the transistor 112.

Moreover, as can be known from FIG. 1, the control circuit 110 of the present invention may be implemented as a single chip, thereby reducing the cost of the driving circuit 100. In other words, the driving circuit 100 of the present invention may be a single stage driving circuit.

Figure 5:
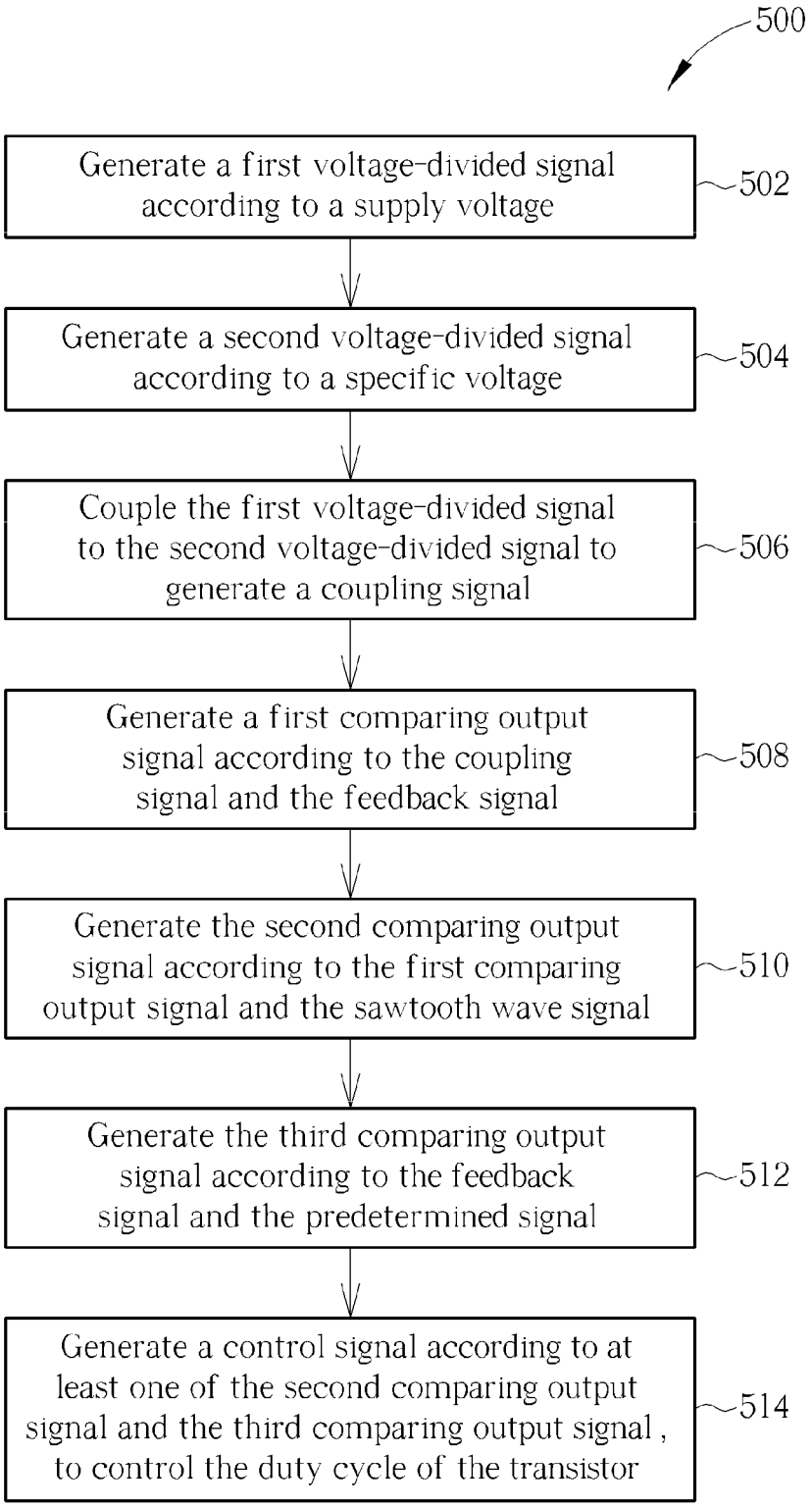
FIG. 5 is a diagram illustrating a circuit driving method according to an embodiment of the present invention.

It should be noted that the operation of the above embodiments of the driving circuit 100 may be simplified as the method and flow shown in FIG. 5, which is a diagram illustrating a circuit driving method 500 according to an embodiment of the present invention. The circuit driving method 500 is used to drive the LED 118 shown in FIG. 1. Hence, please also refer to the driving circuit 100 shown in FIG. 1 when reading the following description directed to the circuit driving method 500. Provided that substantially the same result is achieved, the steps of the flowchart shown in FIG. 5 need not be in the exact order shown and need not be contiguous; that is, other steps can be intermediate. Besides, some of the steps shown in FIG. 5 can be omitted according to different embodiments or design requirements. The circuit driving method 500 includes the following steps:

Step 502: Generate a first voltage-divided signal V1 according to a supply voltage Vs;

Step 504: Generate a second voltage-divided signal V2 according to a specific voltage Vp;

Step 506: Couple the first voltage-divided signal V1 to the second voltage-divided signal V2 to generate a coupling signal Sac;

Step 508: Generate a first comparing output signal Sc1 according to the coupling signal Sac and the feedback signal Sfb;

Step 510: Generate the second comparing output signal Sc2 according to the first comparing output signal Sc1 and the sawtooth wave signal St;

Step 512: Generate the third comparing output signal Sc3 according to the feedback signal Sfb and the predetermined signal Sp; and Step 514: Generate a control signal Sc according to at least one of the second comparing output signal Sc2 and the third comparing output signal Sc3, to control the duty cycle of the transistor 112.

It can be known from the embodiment shown in FIG. 1 that, when the voltage level of the feedback signal Sfb does not exceed the voltage level of the predetermined signal Sp, the driving circuit 500 would mainly generate the control signal Sc in accordance with the second comparing output signal Sc2, to control the duty cycle of the transistor 112; and when the voltage level of the feedback signal Sfb exceeds the voltage level of the predetermined signal Sp, the driving circuit 500 would generate the control signal Sc in accordance with the second comparing output signal Sc2 and the third comparing output signal Sc3, to control the duty cycle of the transistor 112. Therefore, the greater is the amplitude of the AC input voltage Vs, the smaller the duty cycle of the transistor 112 which can be rectified by the driving circuit 500 is, thus allowing the average output current which flows through the LED 118 to remain substantially unchanged or at least remain in an acceptable range.

In summary, the above embodiments of the present invention mainly use a set of voltage dividing circuits (104 and 106) and a coupling circuit (108) to input an AC signal into a control circuit (110), and control the duty cycle of a transistor (112) in accordance with the AC signal, thus allowing the average output current which flows through the LED (118) to remain substantially unchanged or at least remain in an acceptable range. Further, in addition to having lower manufacturing costs, the above embodiments of the present invention have better linear regulating ability and power factor correction functionality.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving circuit, comprising:

a first voltage dividing circuit, arranged to generate a first voltage-divided signal according to a supply voltage;

a second voltage dividing circuit, arranged to generate a second voltage-divided signal according to a specific voltage;

a coupling circuit, coupled between the first voltage dividing circuit and the second voltage dividing circuit, the coupling circuit arranged to couple the first voltage-divided signal to the second voltage-divided signal for generating a coupling signal; and a control circuit, arranged to generate a control signal according to at least the coupling signal and a feedback signal for controlling a duty cycle of a transistor;

wherein the feedback signal is generated by the transistor.

2. The driving circuit of claim 1, wherein the coupling circuit is a capacitive component.

3. The driving circuit of claim 1, wherein the specific voltage is a constant voltage.

4. The driving circuit of claim 1, wherein the control circuit comprises:

a first comparing circuit, arranged to generate a first comparing output signal according to the coupling signal and the feedback signal;

a second comparing circuit, arranged to generate a second comparing output signal according to the first comparing output signal and a sawtooth wave signal;

a third comparing circuit, arranged to generate a third comparing signal according to the feedback signal and a predetermined signal; and a switch control circuit, coupled between the second and the third comparing circuit, the switch control circuit arranged to generate the control signal according to at least one of the second comparing output signal and the third comparing output signal, to control the duty cycle of the transistor.

5. The driving circuit of claim 4 wherein the first comparing circuit is an operational transconductance amplifier.

6. The driving circuit of claim 4, wherein the sawtooth wave signal is a triangular wave signal.

7. The driving circuit of claim 4, wherein when the feedback signal does not exceed the predetermined signal, the switch control circuit generates the control signal according to the second comparing output signal, to control the duty cycle of the transistor.

8. The driving circuit of claim 4, wherein when the feedback signal exceeds the predetermined signal, the switch control circuit generates the control signal according to the second comparing output signal and the third comparing output signal, to control the duty cycle of the transistor.

9. The driving circuit of claim 1, wherein the second voltage dividing circuit comprises:

a first resistive component, having a first terminal coupled to the specific voltage; and a second resistive component, having a first terminal coupled to a second terminal of the first resistive component, and a second terminal coupled to a reference voltage;

wherein the second terminal of the first resistive component is used to provide the second voltage-divided signal.

10. The driving circuit of claim 9, wherein the first voltage dividing circuit comprises:

a first resistive component, having a first terminal coupled to the supply voltage; and a second resistive component, having a first terminal coupled to a second terminal of the first resistive component, and a second terminal coupled to a reference voltage;

wherein the second terminal of the first resistive component is used to output the first voltage-divided signal, the coupling circuit is coupled between the second terminal of the first resistive component of the first voltage dividing circuit and the second terminal of the first resistive component of the second voltage dividing circuit, and the second terminal of the first resistive component of the second voltage dividing circuit is used to output the coupling signal.

11. The driving circuit of claim 1, wherein a first connection terminal of the transistor is coupled to the supply voltage, a control terminal of the transistor is coupled to the control signal, and the control circuit further comprises:

an inductive circuit, having a first terminal coupled to a second connection terminal of the transistor, and a second terminal coupled to a first terminal of a load; and a first diode, having a first terminal coupled to a second terminal of the load, and a second terminal used to output the feedback signal.

12. The driving circuit of claim 11, further comprising:

a resistive circuit, having a first terminal coupled to the second terminal of the load, and a second terminal coupled to a reference voltage.

13. The driving circuit of claim 11, further comprising:

a resistive circuit, having a first terminal coupled to the second terminal of the load, and a second terminal coupled to the first terminal of the first diode.

14. The driving circuit of claim 11, further comprising:

a second diode, having a first terminal coupled to the second terminal of the inductive circuit, and a second terminal used to output the specific voltage.

15. The driving circuit of claim 14, further comprising:

a resistive circuit, having a first terminal coupled to the second terminal of the inductive circuit, and a second terminal coupled to the first terminal of the second diode.

16. The driving circuit of claim 14, further comprising:

a capacitive circuit, having a first terminal coupled to the second terminal of the second diode, and a second terminal coupled to a reference voltage.

17. The driving circuit of claim 11, wherein the load comprises at least one light-emitting diode.

18. A circuit driving method, comprising:

generating a first voltage-divided signal according to a supply voltage;

generating a second voltage-divided signal according to a specific voltage;

coupling the first voltage dividing circuit to the second voltage dividing circuit for generating a coupling signal; and generating a control signal according to at least the coupling signal and a feedback signal for controlling a duty cycle of a transistor;

wherein the feedback signal is generated by the transistor.

19. The circuit driving method of claim 18, wherein the step of generating the control signal according to at least the coupling signal and the feedback signal comprises:

generating a first comparing output signal according to the coupling signal and the feedback signal;

generating a second comparing signal according to the first comparing output signal and a sawtooth wave signal;

generating a third comparing output signal according to the feedback signal and a predetermined signal; and generating the control signal according to at least one of the second comparing output signal and the third comparing output signal, to control the duty cycle of the transistor.

20. The circuit driving method of claim 19, wherein when the feedback signal does not exceed the predetermined signal, the control signal is generated according to the second comparing output signal for controlling the duty cycle of the transistor.

21. The circuit driving method of claim 19, wherein when the feedback signal exceeds the predetermined signal, the control signal is generated according to the second comparing output signal and the third comparing output signal for controlling the duty cycle of the transistor.

* * * * *